United States Patent [19]

Washizuka et al.

[11] 4,448,542

[45] May 15, 1984

[54] ELECTRONIC TIMEPIECE

[75] Inventors: Isamu Washizuka, Kyoto; Yutaka Ikemoto, Nara; Hiroshi Tsuda, Kyoto, all of Japan

[73] Assignee: Sharp Kabushiki Kaisha, Osaka, Japan

[21] Appl. No.: 357,754

[22] Filed: Mar. 12, 1982

[30] Foreign Application Priority Data

Mar. 23, 1981 [JP] Japan ..... 56-42987

[51] Int. Cl.[3] ..... G04B 21/08; G04C 9/00

[52] U.S. Cl. ..... 368/63; 368/187

[58] Field of Search ..... 368/69–70, 368/72–74, 82–84, 185, 187, 250, 251

[56] References Cited

U.S. PATENT DOCUMENTS

| | | | |
|---|---|---|---|
| 4,033,108 | 7/1977 | Bennett et al. | 368/187 |
| 4,205,519 | 6/1980 | Deruns | 368/185 |
| 4,358,840 | 11/1982 | Ono et al. | 368/74 |

*Primary Examiner*—Vit W. Miska

*Attorney, Agent, or Firm*—Birch, Stewart, Kolasch & Birch

[57] ABSTRACT

A timepiece has a time set mode and another time-related mode. It comprises a logic circuit for recognizing the time set mode and an electroacoustic transducer responsive to the logic circuit for providing a particular sound in succession when the timepiece is in the time set mode. The present timepiece makes it easy for the user, especially a blind or weak-eyed person, to recognize that the time set mode is in effect.

5 Claims, 4 Drawing Figures

ELECTRONIC TIMEPIECE

BACKGROUND OF THE INVENTION

The invention relates to electronic timepieces of various types including talking timepieces and melody timepieces and, more particularly it relates to an electronic timepiece for providing a particular sound when in a time set mode.

For the above described types of timepieces it is conventional to select a time set mode with a key or keys. The user of such timepiece sometimes forgets whether the time set mode has been selected. Particularly for blind or weak-eyed persons it is difficult to make sure visually whether the timepiece is in the time set mode.

OBJECT AND SUMMARY OF THE INVENTION

Accordingly, it is an object of the present invention to provide an electronic timepiece which provides a particular sound in a time set mode for audionic confirmation that the timepiece has been placed in the time set mode.

According to the present invention, the above object is accomplished by providing a timepiece which comprises means for recognizing the time set mode and means responsive to said recognizing means for providing a particular sound when said timepiece is in time set mode. Preferably, the timepiece further includes means for interrupting operation of said sounding means and returning said timepiece to a normal mode when a time setting input is not introduced within a predetermined period of time after establishment of the time set mode.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
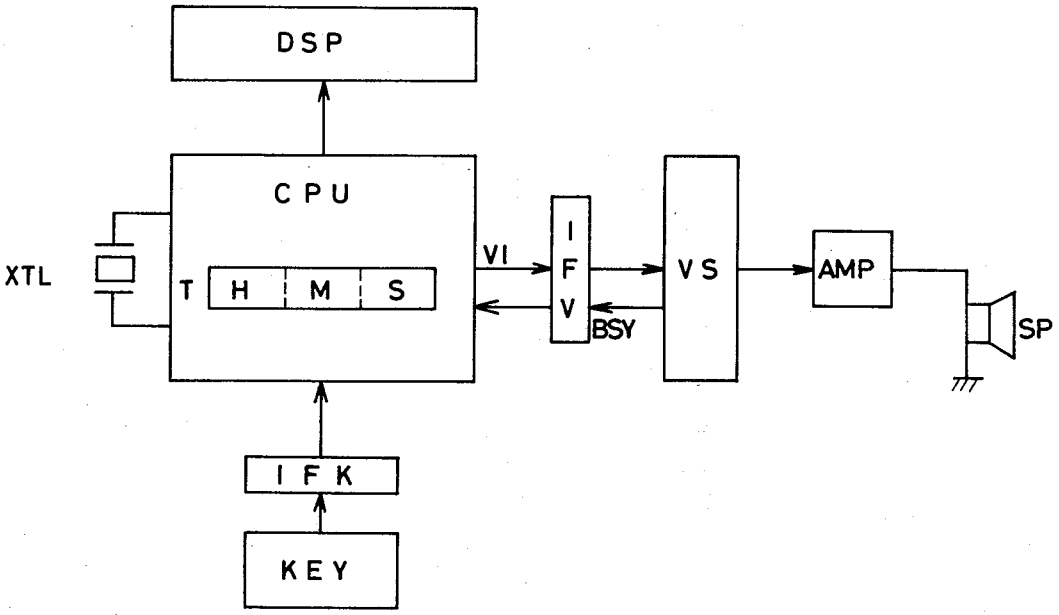
FIG. 1 is a block diagram of an electronic timepiece according to a preferred embodiment of the present invention.

Referring now to FIG. 1, there is illustrated in a schematic view an electronic timepiece designed according to an embodiment of the present invention. A microprocessor or a central processing unit CPU is included for providing all of the operational controls necessary for a crystal vibrator XTL to provide a time standard. There is further provided a time-keeping registor T composed of hours, minutes and seconds sections H, M and S. A display DSP provides digital display of time and a keyboard KEY includes a family of various keys for change-over of timepiece modes, setting time information, delivery of an audible message, etc. Input information originating from actuation of those keys is fed into the CPU by way of an interface IFK.

A voice synthesizer VS is adapted to convert sound information VI fed from the CPU via the interface IFV into an audio signal or message, as well as providing via the interface to the CPU a signal BSY indicative that an audible message is being delivered.

The audible signal or message or the output of the voice synthesizer is power-amplified through a low-frequency amplifier AMP and converted into an audible sound via an electro-acoustic transducer such as a loudspeaker SP.

Figure 2:
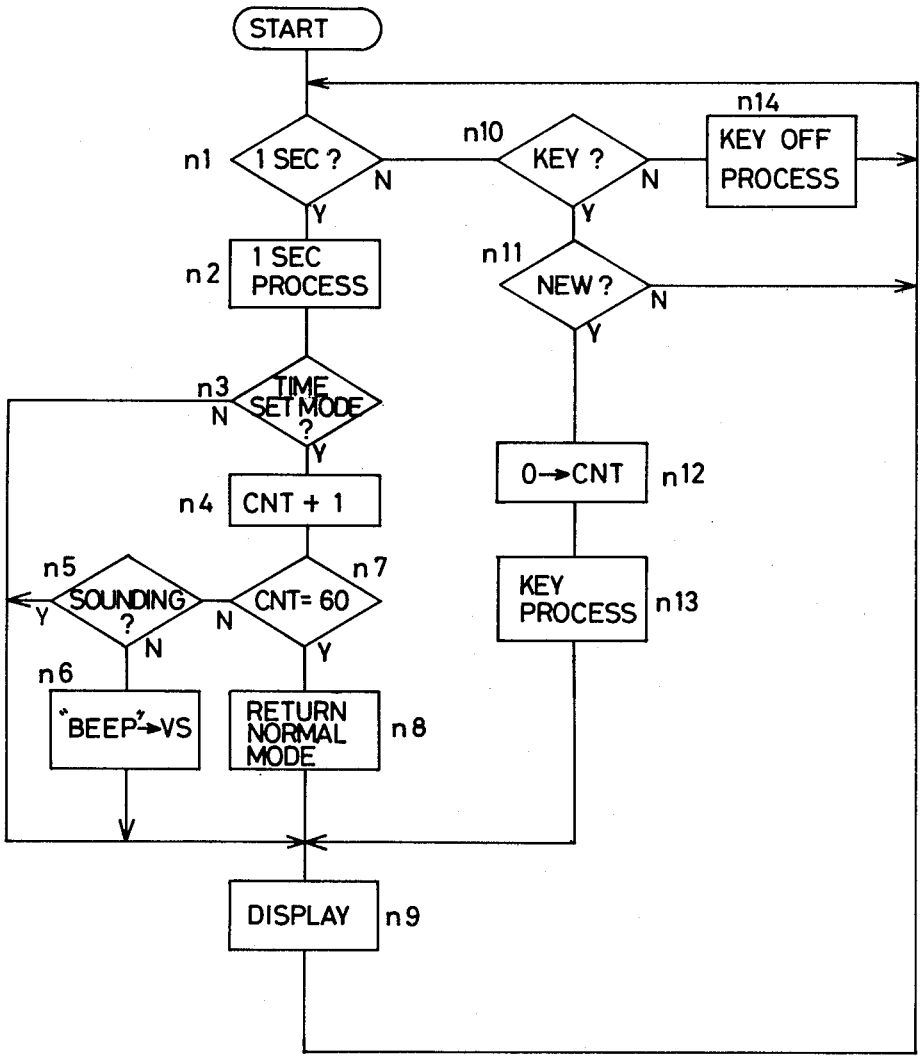
FIG. 2 is a flow chart for explaining operation of the timepiece.

FIG. 2 shows a flow chart for explaining operation during time set mode and giving a better understanding of the electronic timepiece embodying the present invention. As described briefly in the foregoing, the gist of the timepiece resides in provision of a particular sound, typically a short-term sound such as "beep" every second, during time set mode unless any other audible sound is delivered (for example, time anouncement as requested upon actuation of the key or keys). Should no key be actuated within another period of time, for example, 1 minute, the particular sound is halted and the timepiece returns to a normal mode such as a timekeeping mode.

In FIG. 2, step $n_1$ is effected to check the internal state of the CPU and next step $n_2$ is carried out if step $n_1$ finds necessary a process of handling a one-second signal. Otherwise, step $n_{10}$ decides whether a key input is present. If the answer is negative, step $n_{14}$ comes into effect so that a measure is taken to avoid any influence of key bounds as long as any key has been previously depressed. As a result, the timepiece returns to step $n_1$.

On the other hand, if the preceding step $n_{10}$ finds any key input introduced, then step $n_{11}$ decides if any new key is actuated. In the case where the key in question is the same as the previous one, the timepiece forthwise returns to step $n_1$. On the other hand, if the key in question is new, the timepiece proceeds with step $n_{12}$ by which a 2-digit decimal register CNT is initialized to zeros. Step $n_{13}$ effects operations necessary for individual ones of the keys actuated.

Figure 3:
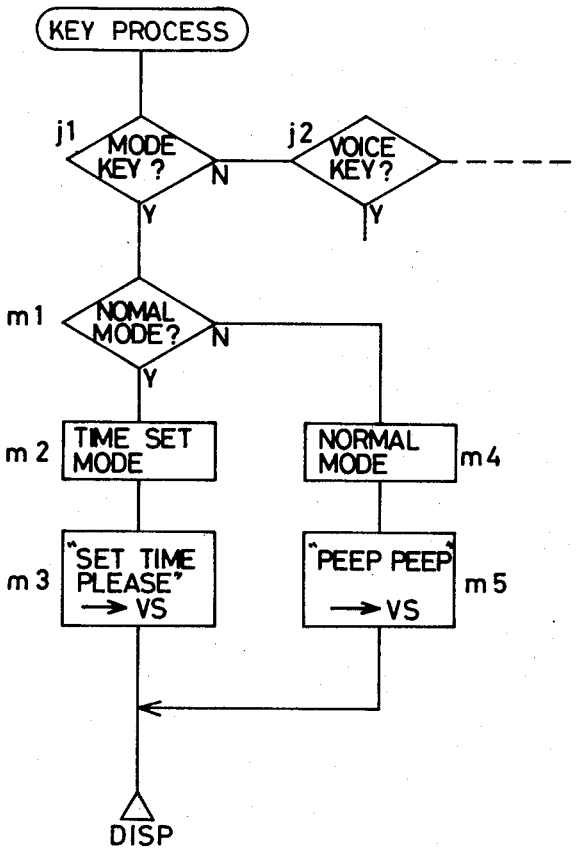
FIG. 3 is a flow chart for explaining an example of a key input process in the timepiece.

A typical example of those key processes is illustrated in FIG. 3 in terms of a mode select key. Step $J_1$ decides if the mode select key is actuated and, if it is actuated, step $m_1$ determines what is the present status of the timepiece. Should the normal mode be sensed, step $m_2$ shifts the timepiece into the time set mode, followed by step $m_3$ by which an audible message, e.g. "set your desired time, please" is furnished to the voice synthesizer VS for delivery of such message. When the timepiece is sensed to be in the time set mode, step $m_4$ restores the normal mode and step $m_5$ furnishes an audible sound, typically "peep peep", to the voice synthesizer VS. Thereafter, the timepiece proceeds with step $n_9$ of FIG. 2 in a manner similar to step $m_3$.

If step $n_1$ in FIG. 2 finds necessary the step of processing the one-second signal, then step $n_2$ executes all of the steps related to time, including updating of the contents of the timekeeping register, and then calls up for execution of step $n_3$. This step $n_3$ decides what state the timepiece is in and, if the time set mode is recognized, step $n_4$ comes into effect. Otherwise, step $n_9$ is reached.

The above mentioned step $n_4$ adds "1" to the contents of the register CNT each second and step $n_7$ decides if the count of the register runs up to "60", that is, if a minute has gone on without introduction of any input for time setting purposes during the time set mode. With the "affirmative" answer, step $n_8$ changes the mode of the timepiece into the normal mode and moves to step $n_9$.

When the count of the register CNT is less than "60", step $n_5$ is carried out to check for the signal BSY from the voice synthesizer VS to thereby determine whether the voice synthesizer is producing an audible message. The "yes" answer leads to step $n_9$ and the "no" answer leads to step $n_6$ which produces an audible signal "beep" via the voice synthesizer VS and then renders step $n_9$ operative. In step $n_9$, the updated time of the day is fed to and displayed on DSP. Finally, the timepiece returns to step $n_1$. Through repeated execution of the above procedure an audible sound "beep" is delivered in succession during the time set mode.

Since in the above illustrated embodiment the audible sound "beep" is provided immediately after the delivery of an audible message related to a key or keys just actuated, there is a possibility that such audible sound may be interposed between successive actuations of the keys as in the case where a plurality of keys should be actuated in order to introduce a desired time setting, thus causing the user to be confused in operating all of the necessary keys.

Figure 4:
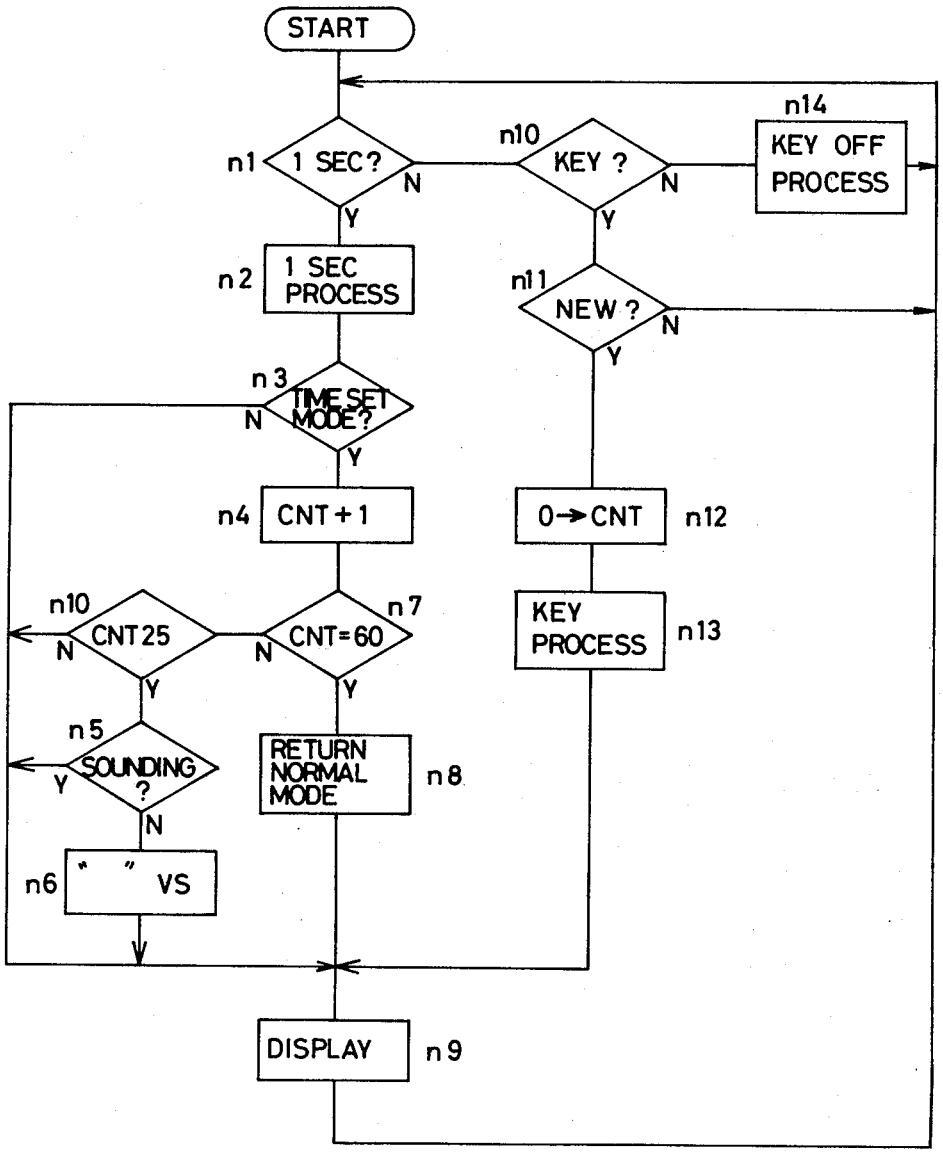
FIG. 4 is a flow chart for explaining operation of another preferred embodiment.

Another embodiment of FIG. 4 is designed to overcome the above discussed problem and especially featured by addition of step $n_{10}$ between steps $n_7$ and $n_5$ in FIG. 2. Step $n_{10}$ decides if the count of the register CNT is "5" or more and, if it is "5" or more, step $n_5$ is carried out. This results in that continued sounds "beep beep" are delivered upon the lapse of 5 seconds after actuation of the keys, so that generation of any sound "beep" is prevented as long as the keys are actuated continuously within a period of 5 seconds.

As stated fully in the foregoing description, the timepiece embodying the present invention provides the particular sound in succession during the time set mode making it easy for the user, especially a blind or weak-eyed person, to recognize that the time set mode is in effect. Furthermore, the time set mode, one of the most important modes of the timepiece having manifold modes including an alarm mode, a timer mode and so on, is easily distinguishable from the others to thereby enhance operability of the timepiece.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A timepiece having a time set mode of operation and another time-related mode of operation, comprising:

timekeeping means;

input means for entering information for setting said timekeeping means when said timepiece is in the time set mode;

voice synthesizing means responsive to said input means for synthesizing first sounds representing information input by said input means;

generating means for generating a second sound in the time set mode for indicating that said timepiece is in the time set mode; and means associated with said timekeeping means for delaying generation of said second sound for a predetermined period following synthesis of said first sounds and for a predetermined period following placing said timepiece in the time set mode.

2. A timepiece as in claim 1, wherein said second sound comprises a sequence of sounds.

3. A timepiece as in claim 1, further comprising means associated with said timekeeping means for placing said timepiece in said another mode of operation when no information is input by said input means for a second predetermined period following placing of said timepiece in the time set mode.

4. A timepiece as in claim 1, wherein said input means comprises a keyboard.

5. A timepiece as in claim 1, further comprising a visual display means for displaying time information.

* * * * *